US005170140A

United States Patent [19]

Lowe et al.

[11] Patent Number: 5,170,140

[45] Date of Patent: Dec. 8, 1992

[54] DIODE PATCH PHASE SHIFTER INSERTABLE INTO A WAVEGUIDE

[75] Inventors: Kathleen Lowe, Redondo Beach; David D. Lynch, Jr., Northridge; Steve Panaretos, Los Angeles; Arthur Seaton, Rancho Palos Verdes, all of Calif.

[73] Assignee: Hughes Aircraft Company, Los Angeles, Calif.

[21] Appl. No.: 498,461

[22] Filed: Mar. 21, 1990

Related U.S. Application Data

[63] Continuation of Ser. No. 231,103, Aug. 11, 1988, abandoned.

[51] Int. Cl.[5] ..... H01P 1/18; H01P 1/185

[52] U.S. Cl. ..... 333/157; 333/161; 333/164; 343/778

[58] Field of Search ..... 333/157, 161, 164, 248, 333/250; 343/777, 778; 342/371-373

[56] References Cited

U.S. PATENT DOCUMENTS

| | | | |
|---|---|---|---|
| 3,277,489 | 10/1966 | Baisdell | 343/778 X |
| 3,825,863 | 7/1974 | Meier | 333/248 X |
| 3,863,181 | 1/1975 | Glance et al. | 333/246 X |
| 4,573,056 | 2/1986 | Dudome et al. | 343/795 |
| 4,575,697 | 3/1986 | Rao et al. | 333/157 |
| 4,616,196 | 10/1986 | Sharma | 333/161 |
| 4,654,611 | 3/1987 | Wong et al. | 333/157 |

FOREIGN PATENT DOCUMENTS

| | | | |
|---|---|---|---|
| 2834905 | 6/1979 | Fed. Rep. of Germany | 333/164 |
| 22459 | 2/1977 | Japan | 333/248 |
| 91701 | 5/1984 | Japan | 333/164 |

*Primary Examiner*—Eugene R. LaRoche
*Assistant Examiner*—Benny T. Lee
*Attorney, Agent, or Firm*—Leonard A. Alkov; Wanda K. Denson-Low

[57] ABSTRACT

A phased array waveguide antenna having a plurality of longitudinally extending parallel waveguides arranged in rows and columns, and electrically controlled phase shifter strips disposed in longitudinally extending slots centrally located in respective columns of waveguides. The electrically controlled phase shifter strips include conductive patches that are selectively conductively connected together by microwave diodes to provide for variable susceptances.

4 Claims, 2 Drawing Sheets

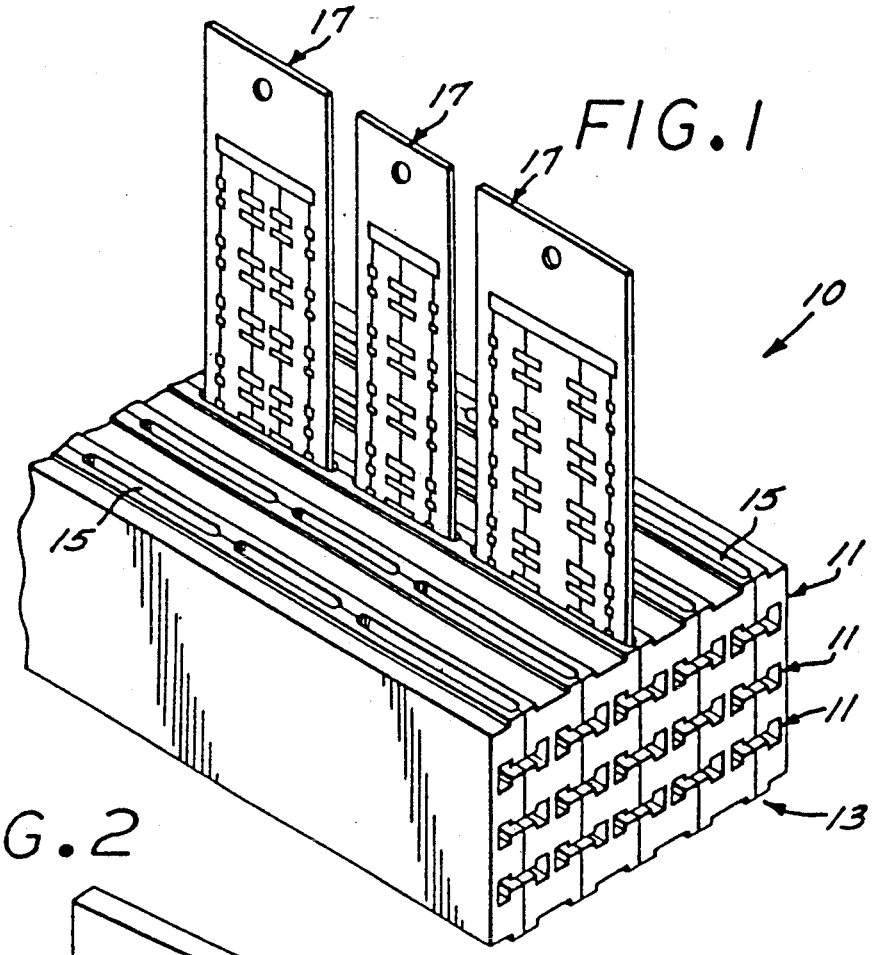
FIG. 1
FIG. 2
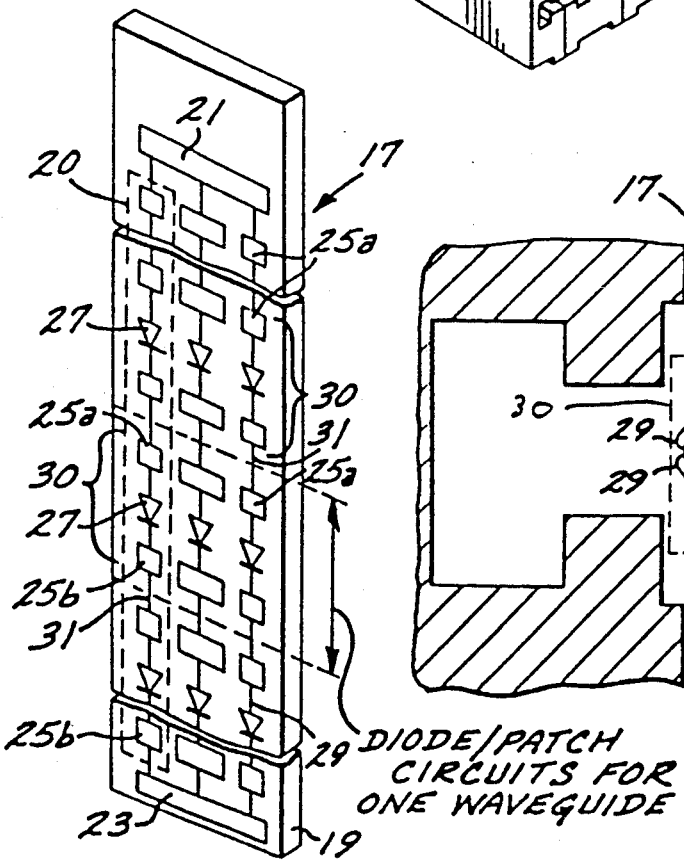
FIG. 3
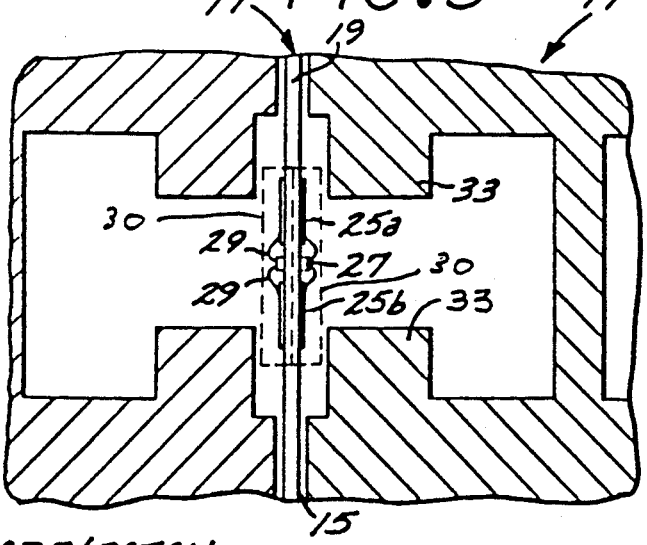

DIODE PATCH PHASE SHIFTER INSERTABLE INTO A WAVEGUIDE

BACKGROUND OF THE INVENTION

The disclosed invention is generally directed to electronically steered phased array antennas, and is more particularly directed to waveguide phase shifter circuitry for controllably phase shifting waveguide propagated electromagnetic energy.

A phased array antenna is a directive antenna comprising, for example, individual radiating elements which generate an electromagnetic radiation pattern having a direction that is controlled by the relative phases of the energy radiated by the individual radiation elements. Thus, the radiation of the phased array is steered by appropriately varying the relative phases of the individual radiation elements. Such variation is provided by appropriately phase shifting the radiation emanated by each element. Such steering is sometimes referred to as beam steering or scanning.

In essence, a phased array antenna provides scanning (i.e., changing beam direction) without mechanically moving the radiation elements, in contrast to a mechanically scanned antenna wherein the radiating elements are mechanically moved. An example of a phased array antenna is a group of parallel, open-ended waveguides, where each waveguide is a radiating element.

It should be understood by persons skilled in the art that phased array antennas also include receiving antennas where the received electromagnetic energy is phase shifted to provide electronic scanning.

Background information on phased array antennas can be found in the textbook *Introduction To Radar Systems,* Skolnik, McGraw-Hill Book Company, 1980, 1962, Chapter 8.

Known phase shifters include structures which utilize diodes to change impedance. An example is the periodically loaded-line phase shifter discussed in the above-reference Skolnik textbook at page 289, which utilizes diodes as switching elements. Important considerations with the loaded-line phase shifter include the requirement of quarter wavelength spacing between susceptance patches which constrains the locations of the diodes, and also the attendant use of many diodes. Moreover, the loaded-line phase shifter would require a large package if adapted for use with waveguides.

Another example of a phase shifter which utilizes diodes is RADANT system, which is discussed in "RADANT: New Method of Electronic Scanning," Microwave Journal, February 1981, pp. 45–53. Important considerations with the RADANT system include the necessity of a feed antenna such as a horn, and the location of the diode grids or screens outside the waveguide.

A diode phase shifter for a waveguide is disclosed and modelled in the article entitled "Diode Phase Shifter and Model In Waveguide," Lester et al., 1987 IEEE MTT-S Digest, pages 599–602. However, that phase shifter is directed to a single diode circuit forming a transversely oriented structure, which presents implementation complications if used with waveguides.

Known phase shifters also include electromechanical phase shifters wherein circuit elements are mechanically moved. Important considerations as to electromechanical phase shifters include slower switching speeds, size, weight, and complex electromechanical driving circuitry.

Other types of known phase shifters require phase shift apparatus, for example microstrips, that are separate from the main energy propagating medium, for example coaxial cable. Important considerations with such separate phase shift apparatus include transitions, mismatching and power loss.

SUMMARY OF THE INVENTION

It would therefore be an advantage to provide an electronic phase shifter structure for waveguides which is compact and provides high switching speeds.

Another advantage would be to provide an electronically controlled phase shifter structure which is readily incorporated in a waveguide array.

The foregoing and other advantages and features are provided by the invention in a phase shifting structure which includes a waveguide having longitudinal extent for propagating electromagnetic energy. First and second conductive patches and a switching device for controllably conductively coupling the patches are located within the waveguide. The conductive patches are capacitively coupled to the waveguide, whereby the phase of the electromagnetic energy propagated by the waveguide is controlled by the coupled and uncoupled states of the first and second conductive patches as controlled by the switching device.

BRIEF DESCRIPTION OF THE DRAWING

The advantages and features of the disclosed invention will readily be appreciated by persons skilled in the art from the following detailed description when read in conjunction with the drawing wherein:

FIG. 1 is a schematic partial cut-away perspective of a waveguide phased antenna array that incorporates the phase shifter circuitry of the invention.

FIG. 2 is a schematic illustration of a phase shifter strip in accordance with the invention.

FIG. 3 is a sectional view of one of the waveguides of FIG. 1.

DETAILED DESCRIPTION

Figure 4:
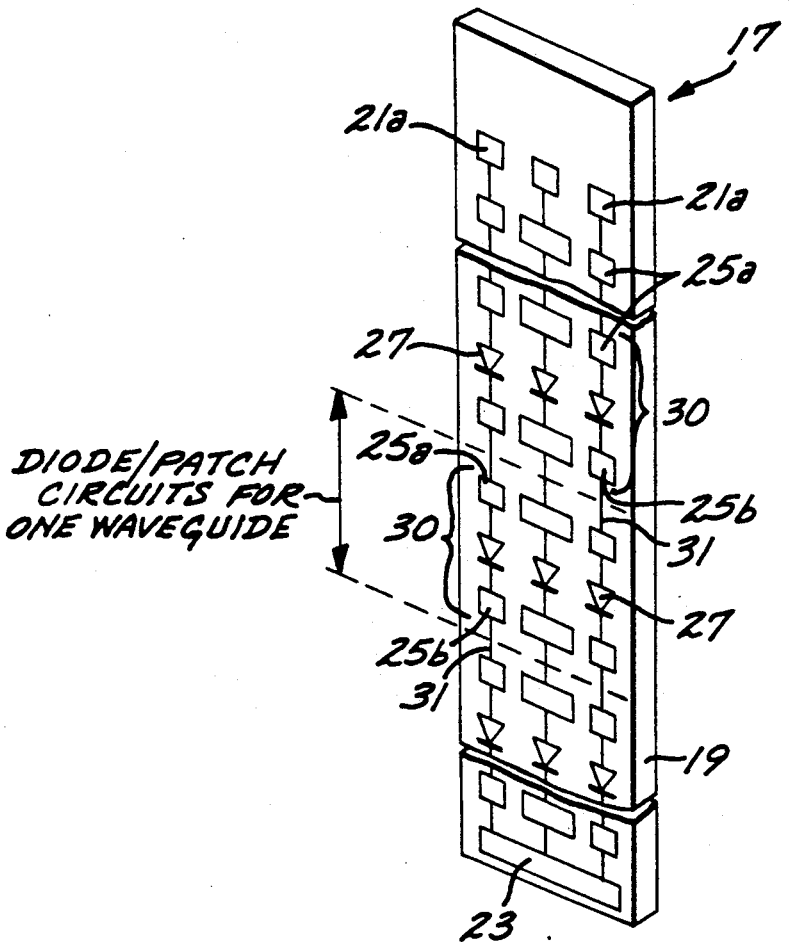
FIG. 4 is a further embodiment of a phase shifter strip in accordance with the invention.

In the following detailed description and in the several figures of the drawing, like elements are identified with like reference numerals.

Referring now to FIG. 1, shown therein is a schematic partial cut-away perspective view illustrating a waveguide antenna array 10 having a plurality of parallel, rectangular waveguides 11 arranged in rows and columns, as partially shown in FIG. 1. The electromagnetic energy radiated by the waveguides 11 emanates from the open ends thereof, which together comprise the aperture 13 of the antenna.

The waveguide antenna array 10 includes a plurality of longitudinal slots 15 which respectively extend through the center of each column of waveguides 11. Each longitudinal slot accepts a phase shifter strip 17, each of which is controllable to change the phase of radiation provided by the column of waveguides with which it is associated.

Referring now to FIG. 2 and 3, each of the phase shifter strips 17 includes a planar dielectric substrate 19, which by way of example can comprise Teflon quartz. A plurality of shifter circuits 20 are secured in columnar arrangement to each side of the substrate 19, the shifter circuits on one side of the substrate 17 being a mirror image of the shifter circuits 20 on the other side for symmetry. Also, the arrangement of the shifter circuits 20 are symmetrical about the vertical centerline of the substrate 19.

In FIG. 2, each shifter circuit 20 is connected at each end to top and bottom driver pads 21, 23 located on each side of the substrate 19. The top driver pads 21 are conductively connected together, and the bottom driver pads 23 are conductively connected together. As discussed further herein, control voltages are applied across the top and bottom driver pads 21, 23.

Each shifter circuit 20 includes serially connected diode/patch circuits 30, each of which is associated with a certain waveguide, as indicated on FIG. 2. Each diode/patch circuit 30 includes first and second conductive patches 25*a*, 25*b* respectively connected via short, high conductance conductors 29 to the anode and cathode of a microwave diode 27 which by way of example can be PIN diode. Each diode/patch circuit 30 is connected via high inductance conductors 31 to the susceptance patches of another diode/patch circuit or to a driver pad, as appropriate, in such a manner that the microwave diodes 27 are oriented to conduct in the same direction. Thus, by way of specific illustration, the anode connected patch 25*a* of a given diode/patch circuit 30 is connected to the cathode connected patch 25*b* of an adjacent diode/patch circuit 30, if there is one.

As oriented in the figures, each susceptance patch 25*a*, 25*b* has a height and width associated therewith, height being in the vertical direction and width being in the lateral or horizontal direction.

To reduce coupling between the waveguides 11, the high inductance conductors 31 interconnecting the conductive patches 25*a*, 25*b* on adjacent diode/patch circuits 30 can include RF choke inductors (not shown) at the ends connected to the patches.

As illustrated in FIG. 2, the anode connected conductive patches 25*a* of the top diode/patch circuits 30 are connected via high inductance conductors 31 to a top driver pad 21. The cathode connected susceptance patches 25*b* of the bottom diode/patch circuits 30 are connected via high inductance conductors to a bottom driver pad 23.

While FIG. 2 schematically illustrates the microwave diodes 27 as being located between their associated patches 25*a*, 25*b*, such diodes can also be secured to an edge portion of an associated conductive patch.

The susceptance presented to the waveguide by a phase shifter strip 17 is determined by the forward bias and reverse bias states of the microwave diodes 27. When the microwave diodes 27 are forward biased, the first and second conductive patches of each diode/patch circuit 30 are conductively coupled, and a higher susceptance is presented. Such higher susceptance results in radiated energy having a different phase relative to the radiated energy when the diodes 27 are reverse biased. In essence, each phase shifter strip 17 has two states, forward biased and reverse biased, and there is a difference in the phases associated with the two states.

The amount of differential phase shift for a phase shifter strip is controlled by the sizes of the several individual conductive patches, and the effective sizes of connected conductive patches. The differential phase shift refers to the difference in phase between (1) the energy radiated when the shifter is reverse biased and (2) the energy radiated when the shifter is forward biased. Impedance matching is achieved by selective positioning of the respective diode/patch circuits on a given phase shifter strip. The longitudinal spacing between the phase shifter strips for a given column of waveguides should be sufficiently large to prevent interference between the phase shifter strips.

The diodes 27 in a given phase shifter strip 17 are forward biased by selective application of a sufficient voltage across the top and bottom driver pads 21, 23, with the top driver pad 21 being positive relative to the bottom driver pad. Such voltage should be greater than the sum of the forward bias voltage drops of the diodes 27 in such shifter circuit. Thus, if there are five (5) diode/patch circuits 30 serially connected in each shifter circuit 20, and each diode 27 has a forward drop of 1.2 volts, the forward biasing voltage across the top and bottom driver terminals should be at least 6 volts.

Reverse bias is provided by applying a sufficiently negative voltage to the top driver pad to prevent the diodes from being forward biased by the waveguide propagated energy, for example, −5 to −100 volts for each diode.

Referring now to FIG. 3, shown therein is a cross-sectional view of one of the waveguides 11, which is generally H-shaped in cross-section with centrally located parallel ridges 33 that are symmetrically disposed on either side of the longitudinal slots. For symmetry, the top and bottom ridges 33 are mirror images.

As illustrated in FIG. 3, the conductive patches at the top of the diode/patch circuits 30 for a given waveguide 11 are adjacent the top ridges 33, while the conductive patches at the bottom of the diode/patch circuits are adjacent the bottom ridges 33. The proximity of the conductive patches to the ridges 33 provides for capacitive coupling of the conductive patches to the waveguide.

By way of example, the phase shifter strips 17 can comprise digitally switched phase shifters wherein discrete phase shifts are provided, and each of the phase shifter strips 17 for a given column of waveguides can provide a predetermined differential phase shift.

The amount of phase shift that is controllably introduced by each shifter strip 17 is determined by the incremental phase shift desired. Thus, for a phase shift increment of 11.5 degrees, five shifters would be utilized, each providing successively increasing phase shifts beginning with 11.5 degrees. Each successive shifter would provide twice the phase shift of the next lowest shifter strip. In this example, the shifter strips would provide, in increasing order, phase shifts of 11.25, 22.5, 45, 90 and 180 degrees. It should be readily appreciated that with such phase shifter strips, phase shifts of (Nx11.25) degrees can be obtained, where N is an integer from 0 to 31.

In this arrangement, each of the phase shifter strips is called a "bit," and the desired phase shift is provided by turning on the appropriate bits. Thus, for example, a phase shift of 33.75 degrees would be provided by turning on the 11.25 degree bit and the 22.5 degree bit.

If greater phase resolution is required, then additional bits can be utilized. For example, using a 5.625 degree bit and a 2.8125 degree bit, resulting in a 7-bit system, would provide for 2.1825 degree increments.

The foregoing described phase shifter strip 17 basically has two states: reverse biased and forward biased. As a result, several phase shifter strips are utilized to provide the capability of producing different phase shifts.

It is also contemplated that each of the phase shifter circuits 20 on the phase shifter strip 17 can be individually controlled to be reverse biased or forward biased. As shown in FIG. 4, this is achieved, for example, by providing individual top driver pads 21*a* for each of the phase shifter circuits 20. For symmetry, it would be appropriate to conductively connect the driver pads 21*a* for corresponding mirror image phase shifter circuits 20 on both sides of the substrate 19. All of the phase shifter circuits 20 on the phase shifter strip 17 can be connected together at the bottom driver pad 23, which by way of example are connected to a common reference voltage such as ground, while the individual top driver pads 21*a* would be individually selectively coupled to forward bias and reverse bias voltages. By way of example, for a phase shifter strip 17 having three (3) phase shifter circuits 20 on each side of the substrate, eight (8) different combinations of susceptances can be provided.

With such a phase shifter strip 17 having multiple forward biased states, the number of phase shifter strips 17 required for a given column of waveguides could be reduced to as few as one.

Referring again to FIG. 3, while the illustrated waveguide 11 includes ridges 33, a rectangular waveguide having top and bottom, centrally located, longitudinally extending channels could be utilized to enhance capacitive coupling, with the conductive patches being reasonably close to the channels. Alternatively, a rectangular waveguide without ridges or channels could also be used, with the conductive patches being very close to the upper and lower waveguide walls. It should be readily appreciated that without ridges or channels, the alignment tolerances are more stringent.

It should also be appreciated that the phase shift strips can be used with circular waveguides, with or without capacitive coupling enhancing ridges or channels.

While the foregoing phased array antenna has generally been discussed in the context of radiating electromagnetic energy, it can also be used to differentially phase shift received electromagnetic energy. The waveguides propagate energy, either received or for radiation.

In terms of implementation, the specific number of diode patch circuits, and the sizes of the patches will depend upon factors including desired phase shift, the characteristics of the waveguide, and the desired VSWR (voltage standing wave ratio), and known design procedures can be adapted to designing specific phase shifter strips. For example, the characteristics of different individual diode/patch circuits can be determined as to the waveguide structure to be utilized, for example, by measuring the 2-port scattering parameters. From the scattering parameters, corresponding transmission parameters can be determined, which in turn are utilized for designing a plurality of diode/patch circuits on a phase shifter strip.

Such design can be done with the assistance of an. optimization computer program, such as the optimization program entitled DPSYN15.FORT which is set forth at the end of this description together with listings of a third order Lagrangian interpolation routine called LAGRAN, a sample input data set DPSYN15.DATA, an output data set DPOUT15.DATA based on the sample input data set, and sample basic datasets KTPARM.H040F.DATA, KATPARM.H040R.DATA, KTPARM.H050F.DATA, KTPARM.H050R.DATA, KTPARM.H065F. DATA, and KTPARM.H065R.DATA.

The optimization program DPSYN15.FORT utilizes an optimization routine ZXSSQ which is in a special function FORTRAN library called the IMSL Library, 1982, which was obtained from IMSL, Inc., Houston, Tex. An error residual calculating subroutine must be utilized with the optimization routine ZXSSQ, and the optimization program DPSYN15.FORT includes the subroutine SUB for that purpose.

Generally, the optimization program DPSYN15-.FORT accepts initial approximations of the dimensions and separations of conductive patches for a phase shifter strip of a predetermined differential phase shift. Based on the measured T-parameters set forth in the basic datasets, the program computes the voltage standing wave ratio (VSWR) responses of the all diodes on condition and the all diodes off condition, together with the corresponding phase shift response for the dimension and separation approximations. The difference between the actual overall response and the desired overall response is calculated and the approximations are adjusted to reduce the difference. This process is repeated until the difference is less than a predetermined amount, or until a specified maximum number of iterations is reached.

Referring now to the sample input dataset DPSYN15.DATA, line 20 sets forth the desired differential phase shift. Line 30 sets forth the maximum number of calls to the error residual subroutine SUB, and two parameters utilized by the optimization routine ZXSSQ. Line 40 also sets forth parameters utilized by the optimization routine.

Line 50 sets forth a number which is one greater than the number of patches, and also the number of frequencies of interest. Line 60 sets forth the minimum separation between patches and the maximum width of any patch. Lines 70 through 130 set forth the initial approximations to be utilized by the optimization program.

As to lines 140–340, the first column sets forth identifications of predetermined frequencies which are not explicitly called out, but correspond to the frequencies associated with the T-parameters set forth in the basic datasets. The second column sets forth the desired VSWR's, and the third column sets forth the desired phases which should be negative. The fourth column sets forth desired VSWR weights, while the fifth column sets forth phase shift weights. The VSWR and phase shift weights allows the specification of critical frequencies. The sixth column sets forth the propagation constants of the dielectrically loaded waveguide of interest, while the seventh column sets forth the propagation constants of such waveguide unloaded. Such propagation constants must also be for the frequencies implicitly identified by the first column.

The optimization program DPSYN15.FORT also requires T-parameters for individual mirror image pairs of diode/patch circuits 30, where each pair comprises a first diode/patch circuit (2 patches and 1 diode) on one side of a substrate and a mirror image thereof in the form of a second diode/patch circuit (2 patches and 1 diode) on the other side of the substrate. Such T-parameters are set forth in basic datasets, the number of which will depend on the number of patch heights desired to be included. For each patch height, two basic data sets are required, the first one for the forward biased condition and the second for the reverse biased condition. The two basic datasets for each height can include data for several widths (e.g., six widths). The first line below a basic dataset name (for example, line 20 of KTPARM.H050F.DATA) sets forth the patch height, the number of patch widths, and the number of frequencies. The next line sets forth the first patch width, followed by N groups of three lines, where N is the number of frequencies. The left most entry in the first line in each group of three lines is a frequency identifier (a real number having a fractional part of all 0's, for example 4.00000000). The frequency identifiers represent the actual frequencies associated with the T-parameters. The eight numbers following each frequency identifier are the magnitude and phase terms of four T-parameters.

The T-parameters for each of the other patch widths in a basic dataset are similarly set forth, preceded by a line including a single entry that specifies patch width. Thus, for example, line 670 of KTPARM.H050.DATA sets forth the second patch width, and is followed by 21 groups of three lines, since there are 21 frequencies in this basic dataset.

The basic data sets are read by the optimization program at lines 1470–1560 for one height, lines 1570-1660 for a second height, and lines 1670–1760 for a third height. For each height, the forward biased data is read first, followed by the reverse biased data.

The optimization program utilizes the basic datasets to calculate the T-parameters of any size patch provided the dimensions are in the range of the measured data.

The T-parameters of the approximated patch dimensions and separations are computed by performing a double interpolation over the basic dataset of measured T-parameters.

The first interpolation is an interpolation over the patch widths for each height for each of the T-parameters. The interpolation in this dimension is a third order Lagrangian interpolation and utilizes the above-mentioned LAGRAN subroutine.

The second interpolation is a cubic interpolation for each patch width over the patch heights and is provided by the subroutine GNTERP. For a cubic interpolation, four patch heights are required for each given patch width, one of which can be a height of zero.

The output dataset DPOUT15.DATA sets forth a copy of the input dataset at lines 20–550. Line 620 identifies the number of calls to the optimization subroutine SUB, while line 680 sets forth the sum of the squares of the error residuals SSQ for the response with the final patch dimension and separation approximations. Line 710 indicates whether the criteria of the optimization routine were satisfied.

Lines 740–880 set forth the final patch dimension and separation approximations arrived at by the optimization program.

Lines 900–1150 set forth the response of the final patch approximations in the forward biased condition. The first column indicates frequency; the second column indicates voltage standing wave ratio; the third column indicates the transmission phase of the phase shifter section; the fourth column specifies the magnitude of the transmission coefficient; and the fifth column specifies insertion loss in dB.

Lines 1170–1410 set forth the response of the final patch approximations in the reverse biased or off condition. The columns are arranged as with the forward biased response in lines 900–150.

Lines 1430–1640 set forth the differential phase shift response of the final patch approximations. The first column indicates frequency while the second column indicates differential phase shift. The entries in the second column are calculated by subtracting, for each frequency, the off condition transmission phase from the on condition transmission phase.

The foregoing has been a disclosure of waveguide phase shifter circuitry which is incorporated within a waveguide by longitudinal slots that do not affect the operation of the waveguide, providing for a compact antenna structure of relatively light weight. The phase shifter circuitry does not require media transitions, and provides for excellent impedance matching. The phase shifter circuitry is not structurally complex, and is amenable to automated manufacturing procedures.

Although the foregoing has been a description and illustration of specific embodiments of the invention, various modifications and changes thereto can be made by persons skilled in the art without departing from the scope and spirit of the invention as defined by the following claims.

What is claimed is:

1. A phase shifting structure comprising:

a waveguide having top and bottom walls and a longitudinal extent for propagating electromagnetic energy therealong;

a top slot and an associated bottom slot respectively formed in the top and bottom walls of the waveguide, said slots being vertically aligned and extending longitudinally;

a plurality of three or more single split conducting strip diode/patch circuits on a planar substrate positioned in said vertically aligned slots with the diode/patch circuits arranged successively along the longitudinal extent in the waveguide, each diode/patch circuit comprising (a) top and bottom conductive patches having substantial longitudinal extent respectively capacitively coupled to the top and bottom walls and (b) a diode for controllably electrically connecting said top and bottom conductive patches to each other, the number of diode/patch circuits, the sizes of said patches and the separation between diode/patch circuits preselected to exclude an odd number of quarter wavelength separation to provide respective predetermined phase shifts as a function of the forward or reverse biased states of said diodes; and means for controlling the states of said diodes of said plurality of diode/patch circuits.

2. The phase shifting structure of claim 1 wherein the states of the diodes of said plurality of diode/patch circuits are controlled together.

3. The phase shifting structure of claim 1 wherein the states of the diodes of said plurality of diode/patch circuits are controlled individually.

4. The phase shifting structure of claim 1 wherein said top and bottom waveguide walls respectively include longitudinally extending ridges adjacent said first and second conductive patches.

* * * * *